United States Patent [19]

Reed

[11] Patent Number: 4,769,856

[45] Date of Patent: Sep. 13, 1988

[54] ANTI-STATIC GLOVES

[76] Inventor: Robert L. Reed, 4807 Big Horn St., Orlando. Fla. 32819

[21] Appl. No.: 74,094

[22] Filed: Jul. 16, 1987

[51] Int. Cl.[4] ..... A41D 19/00

[52] U.S. Cl. ..... 2/167; 2/161 R; 2/168

[58] Field of Search ..... 2/159, 161 R, 167, 169, 2/168

[56] References Cited

U.S. PATENT DOCUMENTS

| | | | |
|---|---|---|---|
| 1,179,871 | 4/1916 | John | 2/168 |
| 1,769,977 | 7/1930 | Watkins | 2/168 |
| 2,058,221 | 10/1936 | Ferguson | 2/168 |
| 2,907,046 | 10/1959 | Scherr | 2/161 R |
| 3,945,049 | 3/1976 | Barlow | 2/167 X |
| 4,670,330 | 6/1987 | Ishiwata | 2/167 X |

*Primary Examiner*—Louis K. Rimrodt
*Assistant Examiner*—J. L. Olds
*Attorney, Agent, or Firm*—Macdonald J. Wiggins

[57] ABSTRACT

An anti-static glove is formed from a porous cloth-type material having the palm inner thumb, and inner finger surfaces covered by a cutout of thin anti-static polyvinyl chloride film. the glove may be used in handling vinyl phonograph records without causing buildup of static charges thereon. The cutout is attached by stitching or by adhesive.

6 Claims, 1 Drawing Sheet

ANTI-STATIC GLOVES

BACKGROUND OF THE INVENTION

1. Field of the Invention

The present invention is directed to a specialized glove for prevention of static electricity buildup on objects to be handled, and more specifically to a glove for handling vinyl phonographic records.

2. Description of the Prior Art

It is well known that handling of vinyl stereo and long play phonograph records results in static buildup on the records which attracts dust. Oil from the fingers during such handling will cause dust to stick to the records even after discharge of any static charge. There are known to be various devices such as anti-static brushes, cloths, and the like with which phonograph records may be wiped or dusted prior to and after use for minimizing dust. However, such treatment is an inconvenience to the user and it is common for all but the audiophile to neglect such precautions. Thus, a glove having inherent built-in static protection to prevent static buildup and oil from the hand contaminating the record would solve this problem.

Anti-static gloves are available in the marketplace for the handling of electronic components and the like. For example, such gloves are available from Oak Technical, Inc., a subsidiary of the Oak Rubber Company. These gloves are formed from a thin, vinyl film which is a specially formulated blend of polyvinyl chloride (PVC) with an anti-static dissipating agent as an integral part of the glove. However, such gloves are basically impervious to moisture and may be somewhat uncomfortable to many persons due to perspiration and the like when using. Thus, there is a need for a glove having anti-static characteristics which will not cause perspiration and produce discomfort to the user.

SUMMARY OF THE INVENTION

The present invention is an anti-static glove formed from a porous or perforated material having the palm, inner thumb, and inner finger surfaces thereof covered with an anti-static material. A piece of anti-static PVC film such as is available from Oak Technical, Inc. is cut to cover the palm, inner thumb, and finger areas of the hand, and the cutout is sewn or otherwise attached to the palm side of the glove. As will now be recognized, a glove is provided which can be worn for long periods of time without the problem of perspiration. The glove of the invention may be used to handle vinyl phonograph records and other objects which can be damaged by static electricity. The imperviousness of the PVC material prevents oil from the fingers and hand from being transferred to the surface of a record or other objects being handled. Such gloves can be made very economically and replaced frequently when necessary.

It is therefore a principal object of my invention to provide a low-cost anti-static glove which is comfortable to wear, and which will protect objects such as vinyl phonograph records from body oil and static charges.

It is another object of my invention to provide an anti-static glove having a loosely woven glove portion with a laminated palm portion formed from an anti-static plastic material.

These and other objects and advantages of the invention will become apparent from the following detailed description when read in conjunction with the drawings.

DETAILED DESCRIPTION OF THE PREFERRED EMBODIMENT

Figure 1:
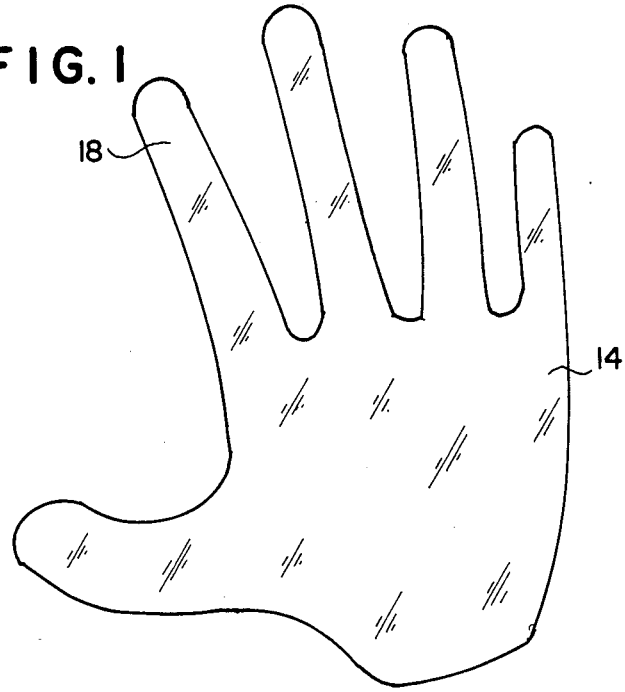
FIG. 1 shows a cutout of an anti-static plastic material for application to a glove.
Figure 3:
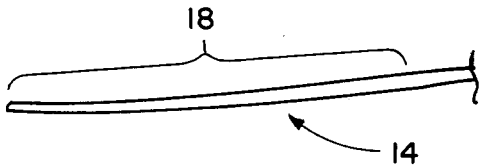
FIG. 3 shows a partial view of the cutout portion of the glove of FIG. 1 showing tapering of the thickness of the fingertip areas.

Referring to FIG. 1, a cutout of a thin film of polyvinyl chloride is shown. The material includes an anti-static dissipating agent as an integral part thereof and such material is available from Oak Technical, Inc., a subsidiary of the Oak Rubber Company. The material of cutout 14 may be on the order of 0.006" thickness and can be formed to have slightly less thickness at the fingertip areas 18 if increased sensitivity is needed as shown in FIG. 3. As will be noted, the cutout 14 of FIG. 1 has elements thereof shaped to fit the thumb and palm area of a glove.

Figure 2:
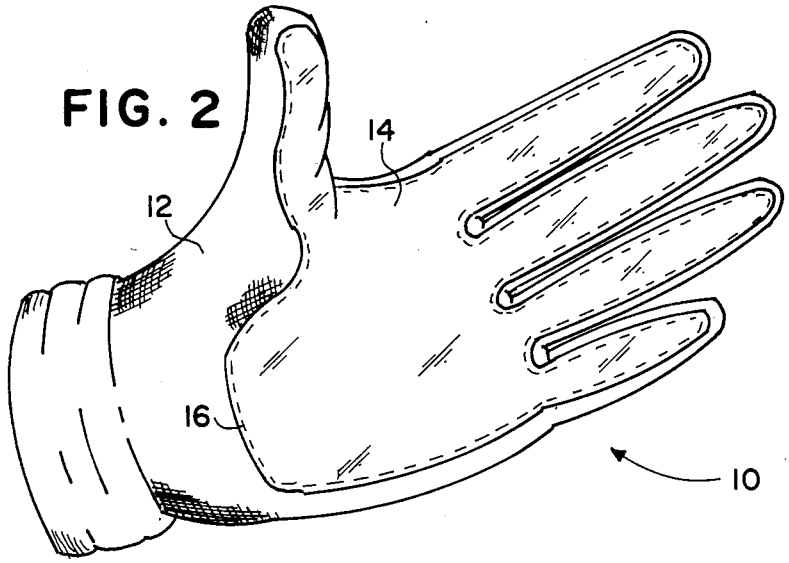
FIG. 2 shows the anti-static material of FIG. 1 sewn to a loosely woven glove.

In FIG. 2 a completed glove in accordance with the invention is shown. A glove 12 of a loosely woven material such as cotton or the like is provided. The palm cutout 14 of FIG. 1 is shown attached by stitches 16 such that the inner surfaces of the thumb, fingers, and palm of the glove are covered by the anti-static PVC film of FIG. 1. Thus, a person wearing glove 10 may safely handle vinyl phonograph records, and other objects which would otherwise become contaminated by static electricity or oil from the hand.

Although the use of a low cost cotton glove 12 and the PVC palm cutout 14 will produce a very low cost glove, it is also possible to produce a throwaway glove using a lower cost material made for disposable cleaning cloths. Such material is a loosely woven paper product having the feel of cloth and woven to provide a small amount of stretch. Such material is available from Chicopee Mills, Inc. and is referred to by the trademark MASSLINN®.

Various alternative constructions will be apparent to those of skill in the art. For example, palm cutout 14 may be attached to the glove portion 12 by any suitable adhesive rather than by stitching. Alternatively, a glove 12 may be provided having the palm, and inner thumb and finger areas cut out with palm cutout 14 attached by sewing or the like to cover the cutout portion. This construction will permit more sensitivity or feel to the user at the fingertip areas when a tapered thickness palm cutout 14 is used.

Other variations in the construction of a glove having an anti-static and impermeable palm area will be apparent to those of skill in the art, and such variations are to be considered within the scope and spirit of the invention.

I claim:

1. An anti-static glove comprising:

a glove formed from porous cloth-type material;

a cutout from polyvinyl chloride film having an anti-static dissipative element integral therewith, said cutout including a profile of fingers, thumb and palm areas of a hand, said cutout disposed over the fingers, thumb and palm areas of said glove; and means for securing said cutout over said areas of said glove.

2. The glove as recited in claim 1 in which said securing means utilizes stitching around the periphery of said cutout.

3. The glove as recited in claim 1 in which said securing means utilizes an adhesive cement.

4. The glove as recited in claim 1 in which said porous material is loosely woven cloth.

5. The glove as recited in claim 1 in which said porous material is a loosely woven cloth-like paper material.

6. The glove as recited in claim 1 in which the thickness of said film tapers from said palm area to a distal end of each of said finger areas and of said thumb area.

* * * * *